US006523583B1

(12) United States Patent
Ruiz

(10) Patent No.: US 6,523,583 B1
(45) Date of Patent: Feb. 25, 2003

(54) WORK BENCH WITH AN EXTENDABLE FOOT STEP ASSEMBLY

(76) Inventor: Hector J. Ruiz, 8327 W. Forest Cir., Tampa, FL (US) 33615

( * ) Notice: Subject to any disclaimer, the term of this patent is extended or adjusted under 35 U.S.C. 154(b) by 0 days.

(21) Appl. No.: 09/953,013

(22) Filed: Sep. 13, 2001

(51) Int. Cl.[7] ..... B25H 1/12
(52) U.S. Cl. ..... 144/285; 144/286.1; 108/115
(58) Field of Search ..... 144/285, 286.1, 144/286.5; 312/902; 182/180.1, 180.3

(56) References Cited

U.S. PATENT DOCUMENTS

| | | | | | |
|---|---|---|---|---|---|
| 1,635,183 | A | * | 7/1927 | Jeannotte | 182/129 |
| 4,265,283 | A | | 5/1981 | Nash et al. | 144/286 R |
| 4,408,642 | A | | 10/1983 | Jeruzal et al. | 144/286 A |
| D337,404 | S | | 7/1993 | Miles | D34/19 |
| 5,224,531 | A | * | 7/1993 | Blohm | 108/110 |
| 5,228,761 | A | * | 7/1993 | Huebschen et al. | 312/235.1 |
| 5,452,908 | A | * | 9/1995 | Bencic | 280/47.35 |
| 5,551,773 | A | | 9/1996 | Cottrell | 312/249.8 |
| 5,725,037 | A | * | 3/1998 | Faulhaber | 144/285 |

* cited by examiner

*Primary Examiner*—Allen Ostrager
*Assistant Examiner*—Shelley Self
(74) *Attorney, Agent, or Firm*—Joseph N. Breaux

(57) ABSTRACT

A moveable work bench with an extendable foot step assembly. The device includes a multi-function bench assembly rollably mounted on spring-loaded caster assemblies and user configurable between a cabinet/workbench configuration and a step stool configuration. The multi-function bench assembly also includes a hinged work surface that may be pivoted into a horizontal position to increase the work surface area and locked in place with locking support for lockably supporting the hinged work surface.

1 Claim, 2 Drawing Sheets

WORK BENCH WITH AN EXTENDABLE FOOT STEP ASSEMBLY

TECHNICAL FIELD

The present invention relates to work benches and more particularly to a work bench with an extendable foot step assembly that includes a multi-function bench assembly rollably mounted on spring-loaded caster assemblies both a manual caster retraction mechanism for manually retracting the spring-loaded casters into an unfunctional position and a weight actuated caster retraction mechanism that operates such that placing weight on the multifunction bench assembly causes the spring-loaded caster assemblies to retract sufficiently to prevent the multi-function bench assembly from being rollable on the spring-loaded caster assemblies; the multi-function bench assembly further including a user configurable cabinet assembly including a bottom cabinet portion provided with a storage area compartment therein and a first non-slip step area below a second U-shaped non-slip step area positioned directly above the first non-slip step area; a drawer cabinet assembly secured to a top side of the bottom cabinet portion adjacent to the second U-shaped non-slip step area, a pivoting hollow step assembly having a top edge hingedly connected to a top edge of the drawer cabinet assembly in a manner such that the pivoting hollow step assembly is pivotal into a step stool configuration wherein a step assembly, nonslip top working area surface is supported on a drawer cabinet assembly top nonslip surface and into a workbench configuration wherein the step assembly, nonslip top working area surface is adjacent to and coplanar with the drawer cabinet assembly top nonslip surface; and a hinged work surface area extension assembly hingedly connected to the top edge of the drawer cabinet assembly along a top edge of the drawer cabinet assembly opposite the a top edge of the drawer cabinet assembly hingedly connected to the pivoting hollow step assembly, and a locking support for lockably supporting the hinged work surface area extension assembly in a horizontal position adjacent to the drawer cabinet assembly top nonslip surface; the pivoting hollow step assembly having an open bottom side providing access into a foot positioning cavity provided therein, a power outlet strip on a sidewall thereof, and a paper towel/gift warp ribbon roller; the drawer cabinet assembly having storage hooks provided on a sidewall thereof and multiple storage drawers.

BACKGROUND ART

It is often desirable to have a moveable work bench assembly having a work surface such that the work bench assembly may be moved to a desired work location and the work performed conveniently. In addition, as it is often necessary to retrieve items from storage on a shelf or the like that is too high to reach without assistance, it would be desirable to have a moveable step stool. It would, therefore, of course be desirable to have a combination moveable work bench and step stool that could be used in either configuration as desired.

GENERAL SUMMARY DISCUSSION OF INVENTION

It is thus an object of the invention to provide a work bench with an extendable foot step assembly that includes a multi-function bench assembly rollably mounted on spring-loaded caster assemblies both a manual caster retraction mechanism for manually retracting the spring-loaded casters into an unfunctional position and a weight actuated caster retraction mechanism that operates such that placing weight on the multi-function bench assembly causes the spring-loaded caster assemblies to retract sufficiently to prevent the multi-function bench assembly from being rollable on the spring-loaded caster assemblies; the multi-function bench assembly further including a user configurable cabinet assembly including a bottom cabinet portion provided with a storage area compartment therein and a first non-slip step area below a second U-shaped non-slip step area positioned directly above the first non-slip step area; a drawer cabinet assembly secured to a top side of the bottom cabinet portion adjacent to the second U-shaped nonslip step area, a pivoting hollow step assembly having a top edge hingedly connected to a top edge of the drawer cabinet assembly in a manner such that the pivoting hollow step assembly is pivotal into a step stool configuration wherein a step assembly, non-slip top working area surface is supported on a drawer cabinet assembly top nonslip surface and into a workbench configuration wherein the step assembly, nonslip top working area surface is adjacent to and coplanar with the drawer cabinet assembly top nonslip surface; and a hinged work surface area extension assembly hingedly connected to the top edge of the drawer cabinet assembly along a top edge of the drawer cabinet assembly opposite the a top edge of the drawer cabinet assembly hingedly connected to the pivoting hollow step assembly, and a locking support for lockably supporting the hinged work surface area extension assembly in a horizontal position adjacent to the drawer cabinet assembly top nonslip surface; the pivoting hollow step assembly having an open bottom side providing access into a foot positioning cavity provided therein, a power outlet strip on a sidewall thereof, and a paper towel/gift warp ribbon roller; the drawer cabinet assembly having storage hooks provided on a sidewall thereof and multiple storage drawers.

Accordingly, a work bench with an extendable foot step assembly is provided. The work bench with an extendable foot step assembly includes a multi-function bench assembly rollably mounted on spring-loaded caster assemblies both a manual caster retraction mechanism for manually retracting the spring-loaded casters into an unfunctional position and a weight actuated caster retraction mechanism that operates such that placing weight on the multi-function bench assembly causes the spring-loaded caster assemblies to retract sufficiently to prevent the multi-function bench assembly from being rollable on the spring-loaded caster assemblies; the multi-function bench assembly further including a user configurable cabinet assembly including a bottom cabinet portion provided with a storage area compartment therein and a first non-slip step area below a second U-shaped non-slip step area positioned directly above the first non-slip step area; a drawer cabinet assembly secured to a top side of the bottom cabinet portion adjacent to the second U-shaped non-slip step area, a pivoting hollow step assembly having a top edge hingedly connected to a top edge of the drawer cabinet assembly in a manner such that the pivoting hollow step assembly is pivotal into a step stool configuration wherein a step assembly, nonslip top working area surface is supported on a drawer cabinet assembly top nonslip surface and into a workbench configuration wherein the step assembly, nonslip top working area surface is adjacent to and coplanar with the drawer cabinet assembly top nonslip surface; and a hinged work surface area extension assembly hingedly connected to the top edge of the drawer cabinet assembly along a top edge of the drawer cabinet assembly opposite the a top edge of the drawer cabinet assembly hingedly connected to the pivoting hollow step assembly, and a locking support for lockably supporting the hinged work surface area extension assembly in a horizontal position adjacent to the drawer cabinet assembly top nonslip surface; the pivoting hollow step assembly having an open bottom side providing access into a foot positioning cavity provided therein, a power outlet strip on a sidewall thereof, and a paper towel/gift warp ribbon roller; the drawer cabinet assembly having storage hooks provided on a sidewall thereof and multiple storage drawers.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
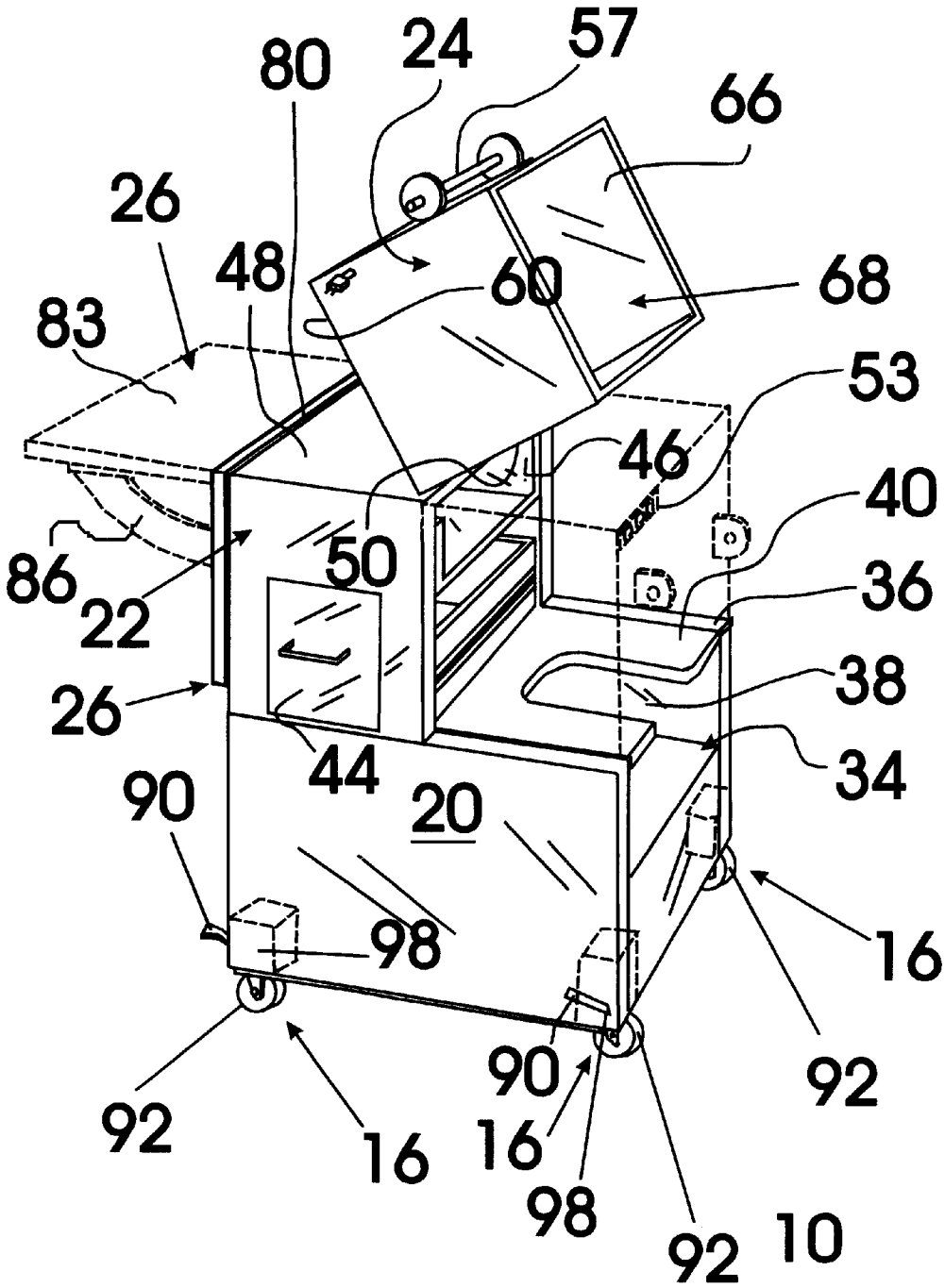
FIG. 1 is a perspective view of an exemplary embodiment of the work bench with an extendable foot step assembly of the present invention.

FIG. 1 and shows various aspects of an exemplary embodiment of the work bench with an extendable foot step assembly of the present invention generally designated 10. Work bench with an extendable foot step assembly 10 includes a multi-function bench assembly, generally designated 12; including a user configurable cabinet assembly, generally designated 14; and four, identical, spring-loaded caster assemblies, each generally designated 16.

Cabinet assembly 14 including a bottom cabinet portion, generally designated 20; a drawer cabinet assembly, generally designated 22; a pivoting hollow step assembly, generally designated 24; and a hinged work surface area extension assembly, generally designated 26.

Bottom cabinet portion 20 is provided with a storage area compartment therein that is accessible through a hinged access door 32. Opposite the access door 32 is a first non-slip step area, generally designated 34 positioned below a second U-shaped non-slip step area 36 with a leg opening 38 between the parallel side portions 40,42 of step area 36 and positioned directly above the first non-slip step area 34.

Drawer cabinet assembly 22 is secured to a top side of bottom cabinet portion 20 adjacent to second U-shaped non-slip step area 36 and includes storage drawers 44,46 and has a drawer cabinet assembly top nonslip surface 48.

Figure 2:
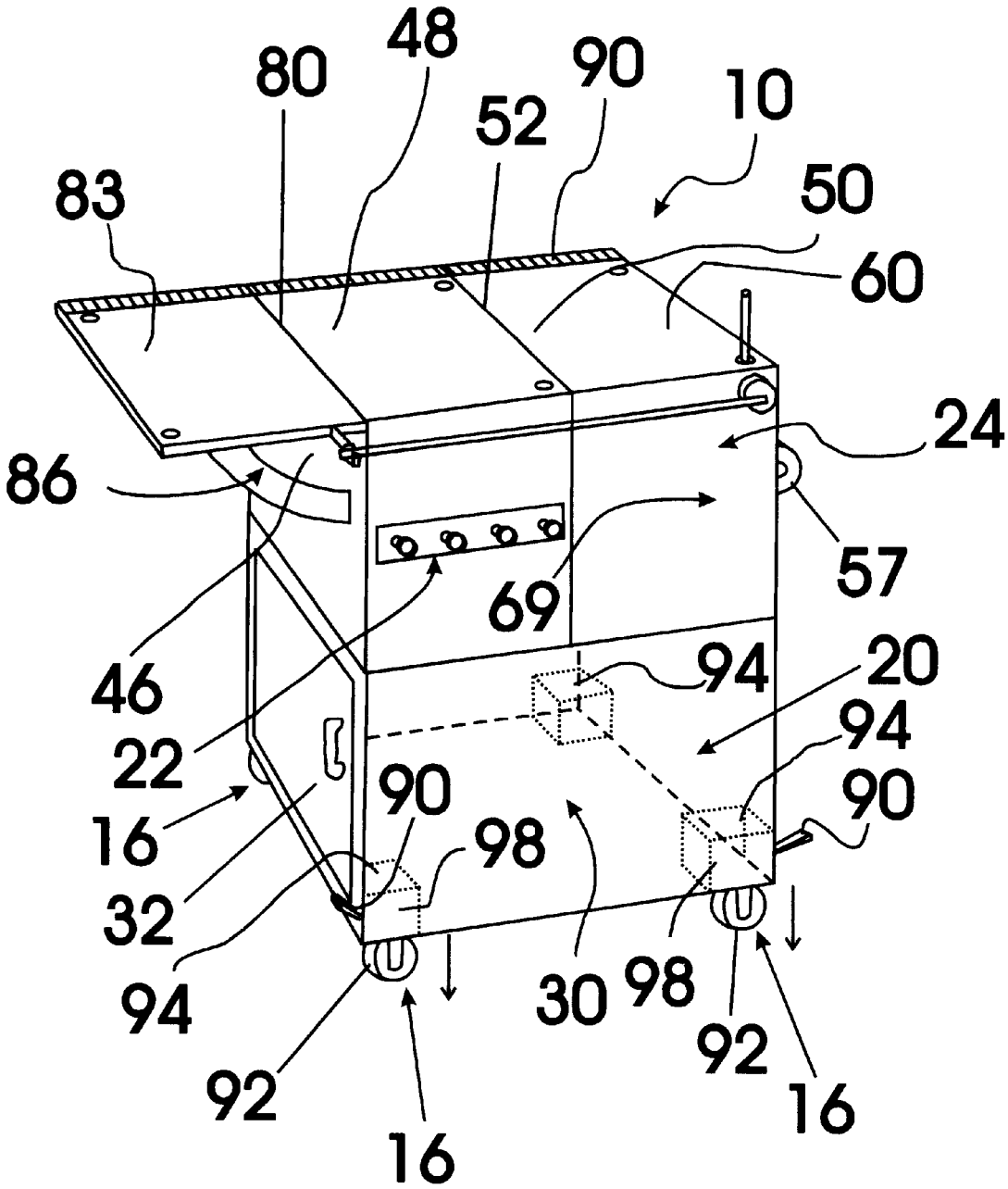
FIG. 2 is a second perspective view of the work bench with an extendable foot step assembly of FIG. 1.

Pivoting hollow step assembly 24 has a top edge 50 hingedly connected to top edge 52 of drawer cabinet assembly top nonslip surface 48 of drawer cabinet assembly 22 in a manner such that pivoting hollow step assembly 24 is pivotal between a step stool configuration wherein a step assembly, nonslip top working area surface 60 parallel with and supported on drawer cabinet assembly top nonslip surface 48 and a workbench configuration (shown in FIG. 2) wherein a foot insertion opening 66 at the bottom 69 of pivoting hollow step assembly 28 and in connection with a foot receiving cavity 68 of pivoting hollow step assembly 24 is supported on second U-shaped non-slip step area 36 of bottom cabinet portion 20 and step assembly, nonslip top working area surface 60 is adjacent to and coplanar with drawer cabinet assembly top nonslip surface 48. Pivoting hollow step assembly 24 includes a power outlet strip 53 on a sidewall thereof, and a paper towel/gift wrap ribbon roller 57.

Hinged work surface area extension assembly 26 includes a work surface member 83 that is hingedly connected to the top edge 80 of the drawer cabinet assembly 22 opposite the top edge 52 of drawer cabinet assembly 22 that is hingedly connected to pivoting hollow step assembly 24. A locking support 86 extends between a sidewall of drawer cabinet assembly 22 and the underside of work surface member 83 for lockably supporting hinged work surface member 83 in a horizontal position adjacent to drawer cabinet assembly top nonslip surface 48. In this embodiment, a measuring tape 90 extends along the side edges of work surface member 83, drawer cabinet assembly top nonslip surface 48 and step assembly, and nonslip top working area surface 60.

In this embodiment, bottom cabinet portion 20 is supported by the four, identical, spring-loaded caster assemblies 16. Each spring-loaded caster assembly 16 has both a manual caster retraction mechanism 90 for manually retracting the spring-loaded casters 92 into a caster receiving cavity 94 so that the caster 92 is withdrawn from contact with the ground surface into an unfunctional position and a weight actuated caster retraction mechanism 98 that operates such that placing weight on the multi-function bench assembly 12 causes the spring-loaded casters 92 to be forced up into a caster receiving cavity 94 sufficiently to prevent the multi-function bench assembly 12 from being rollable on the spring-loaded caster assemblies 16.

It can be seen from the preceding description that a work bench with an extendable foot step assembly has been provided.

It is noted that the embodiment of the work bench with an extendable foot step assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A work bench with extendable foot step assembly comprising:

a multi-function bench assembly rollably mounted on spring-loaded caster assemblies both a manual caster retraction mechanism for manually retracting the spring-loaded casters into an unfunctional position within the bench assembly and a weight actuated caster retraction mechanism that operates such that placing weight on the multi-function bench assembly causes the spring-loaded caster assemblies to retract sufficiently into the bench assembly to prevent the multi-function bench assembly from being rollable on the spring-loaded caster assemblies;

the multi-function bench assembly further including a user configurable cabinet assembly including a bottom cabinet portion provided with a storage area compartment therein and a first nonslip step area below a second U-shaped non-slip step area positioned directly above the first non-slip step area;

a drawer cabinet assembly secured to a top side of the bottom cabinet portion adjacent to the second U-shaped non-slip step area, a pivoting hollow step assembly having a top edge hingedly connected to a top edge of the drawer cabinet assembly in a manner such that the pivoting hollow step assembly is pivotal into a step stool configuration wherein a step assembly, nonslip top working area surface is supported on a drawer cabinet assembly top nonslip surface and into a workbench configuration wherein the step assembly, nonslip top working area surface is adjacent to and coplanar with the drawer cabinet assembly top nonslip surface; and a hinged work surface area extension assembly hingedly connected to the top edge of the drawer cabinet assembly along a top edge of the drawer cabinet assembly opposite the a top edge of the drawer cabinet assembly hingedly connected to the pivoting hollow step assembly, and a locking support for lockably supporting the hinged work surface area extension assembly in a horizontal position adjacent to the drawer cabinet assembly top nonslip surface; the pivoting hollow step assembly having an open bottom side providing access into a foot positioning cavity provided therein, a power outlet strip on a sidewall thereof, and a paper towel/gift warp ribbon roller;

the drawer cabinet assembly having storage hooks provided on a sidewall thereof and multiple storage drawers.

* * * * *